United States Patent [19]

Kuckens

[11] Patent Number: 4,923,644

[45] Date of Patent: May 8, 1990

[54] APPARATUS FOR IMPREGNATING WATER WITH CARBON DIOXIDE

[76] Inventor: Alexander Kuckens, Harvestehuder Weg 28, 2000 Hamburg 13, Fed. Rep. of Germany

[21] Appl. No.: 660,570

[22] Filed: Oct. 16, 1984

Related U.S. Application Data

[63] Continuation of Ser. No. 343,876, Jan. 29, 1982, abandoned, which is a continuation of Ser. No. 91,404, Nov. 6, 1979, abandoned, which is a continuation-in-part of Ser. No. 59,264, Jul. 20, 1979, abandoned.

[30] Foreign Application Priority Data

Jul. 24, 1978 [DE] Fed. Rep. of Germany ..... 2832377
Nov. 7, 1978 [DE] Fed. Rep. of Germany ..... 2848146

[51] Int. Cl.[5] ..... B01F 3/04

[52] U.S. Cl. ..... 261/29; 99/323.1; 261/93; 261/155; 261/DIG. 7; 261/DIG. 27; 261/36.1; 415/203; 426/477

[58] Field of Search ..... 261/29, 36 R, 93, 140 R, 261/152, 155, DIG. 7, DIG. 75, DIG. 27; 426/474, 477; 99/275, 323.1; 415/203-205; 416/185

[56] References Cited

U.S. PATENT DOCUMENTS

| | | | |
|---|---|---|---|
| 2,019,325 | 10/1935 | Stone et al. | 261/93 |
| 2,441,419 | 5/1948 | Hudson | 261/DIG. 7 |
| 2,541,757 | 2/1951 | Grier | 261/140 R |
| 2,586,499 | 2/1952 | Anderson | 261/DIG. 7 |
| 2,926,087 | 2/1960 | Rickers | 261/DIG. 7 |
| 3,092,678 | 6/1963 | Braun | 261/93 |
| 3,374,744 | 3/1968 | Toma | 415/203 |
| 3,400,551 | 9/1968 | Booth et al. | 261/DIG. 7 |
| 4,021,349 | 5/1977 | Kaelin | 261/93 X |
| 4,139,579 | 2/1979 | Blum | 261/93 X |

*Primary Examiner*—Richard L. Chiesa
*Attorney, Agent, or Firm*—Barnes, Kisselle, Raisch, Choate, Whittemore & Hulbert

[57] ABSTRACT

A vessel (1) for impregnating water with carbon dioxide is pressure-tight and has inlets (4, 5) for water and carbon dioxide. Within the vessel, a cooling surface (9) is provided, connected to an external refrigeration circuit. Within the vessel and below the level of water, an underwater pump (15) is provided for producing a circulation of water inside the vessel. Carbon dioxide in finely divided form is introduced into the flowing water, preferably via the pump (15) for producing the water circulation. In use, an ice jacket (11 ) forms on the cooling surface (9).

1 Claim, 2 Drawing Sheets

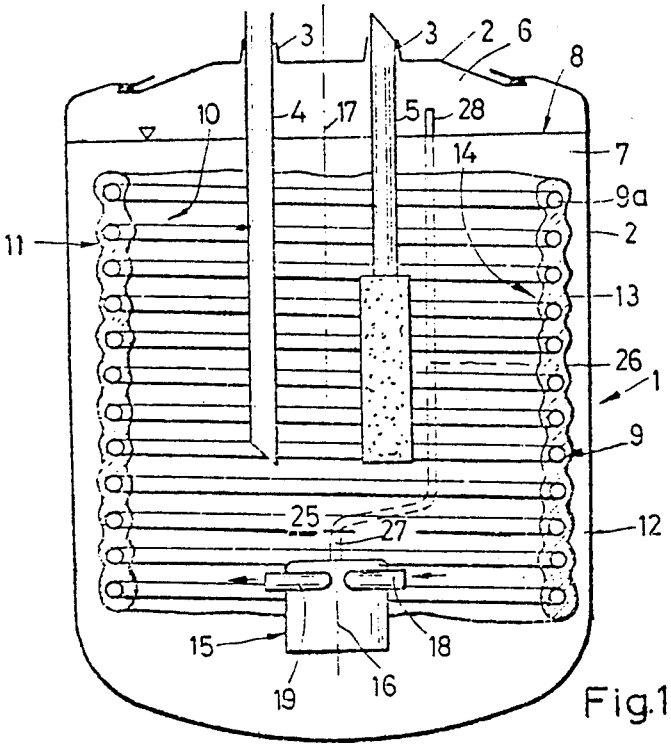
Fig.1
Fig.2
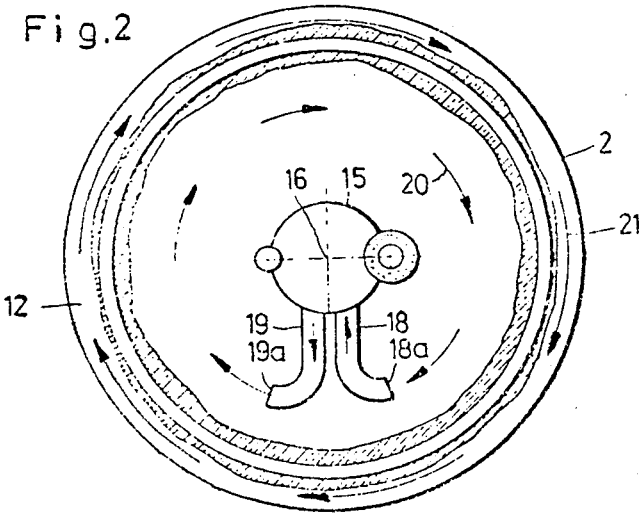

APPARATUS FOR IMPREGNATING WATER WITH CARBON DIOXIDE

This application is a continuation of application, Ser. No. 343,876, filed January 29, 1982, now abandoned, which was a continuation of application, Ser. No. 91,404, filed November 6, 1979, now abandoned, which in turn was a continuation-in-part of application, Ser. No. 59,264, filed July 20, 1979, now abandoned.

The invention relates to the impregnation of water with carbon dioxide in a pressure vessel.

In the production of beverages containing carbon dioxide the manner in which water is impregnated with carbon dioxide gas and the degree of cooling are of decisive significance for the quality of the beverage. This applies particularly where beverages are prepared directly while being delivered from dispensing apparatus or automatic beverage vending machines.

The temperature of the water plays an important part in obtaining optimum impregnation of the water with carbon dioxide and the volumetric capacity of the water for carbon dioxide gas increases with a diminishing water temperature and is a maximum close to the freezing point of water. The manner in which carbon dioxide gas is introduced into the water and the pressure conditions under which impregnation takes place are also important for optimum impregnation of the water. In most cases it is possible to control the pressure conditions externally without difficulty.

Cooling the water to the desired low temperature, maintaining the said temperature independently of the removal of water and the supply of fresh water and the creation of identical temperature conditions in the entire quantity of water in the pressure vessel however gives rise to substantial difficulties. These difficulties could hitherto be overcome only by means of substantial complexity and by using a large amount of space for the apparatus. The high complexity was due on the one hand to the design of the refrigeration unit to provide a correspondingly high output and on the other hand was due to steps designed to effect rapid and adequate heat exchange between the quantity of water and the coolant surface directly immersed therein. It is possible to understand these difficulties when considering that in dispensing apparatus or automatic beverage vending machines the frequency of removal of a metered quantity of water from the pressure vessel can vary exceptionally widely. It is very difficult to ensure a uniform quality of the carbon dioxide-impregnated water removed from the system if the removal operations take place in a rapid sequence.

Furthermore, to limit the rating of the refrigerating unit it may be necessary to provide a reserve of cold on the cooling surface in the form of an ice shield which must have a thickness corresponding to the required cold capacity if the apparatus has a high volumetric removal rate. An ice shield however also forms a kind of thermal insulator between the actual cooling surface and the quantity of water since ice is a relatively poor conductor of heat. The heat exchange between cooling surface and water quantity is therefore severely impaired. To provide a remedy it is known to dispose the cooling surface at a distinct distance from the internal wall of the pressure vessel and to generate a forced flow in the quantity of water which subdivides the cooling surface, which flow is stronger on one side of the cooling surface and distinctly weaker on the other side thereof so that the resultant ice shield grows to a substantial thickness mainly only on that side of the cooling surface along which the water flow is least. The forced flow is generated by means of an agitating vane which is disposed centrally in a part of the pressure vessel bottom which is below the bottom end of the cooling surface, which vane can be driven from outside the vessel without physical contact and is oriented radially towards the outside along the bottom and upwardly perpendicularly along the cooling surface. The flow breaks up in the region of the upper water surface accompanied by the formation of vortices and produces a substantially irregular counterflow, directed downwardly, in the region of the core of the quantity of water. Repeated reversal of the flow as well as break up of the flow on the water level results in substantial deceleration of such flow and in the formation of vortices. It is therefore not possible by means of the known device to achieve a precisely definable forced flow even if a high driving power is introduced by means of the agitating vanes into the quantity of water. The carbon dioxide gas is supplied by means of a gas line which terminates beneath the water level in a cartridge which takes the form of a porous ceramic block through which the gas bubbles out in the form of fine bubbles into the flow generated by the agitator vanes.

Owing to the need to dispose the agitator vane close to the bottom to enable the bottom to be utilized as diffuser surface, it follows that the height of the cooling surface is restricted since the forced flow generated by the agitator vanes extends only over a limited distance in the water. A position of the agitator vane close to the bottom of the container is convenient because of the drive which is transmitted without physical contact. This arrangement calls for a substantial motor rating and the structural height of the system is additionally increased by the externally disposed drive. There is a risk of a substantial proportion of the gas flowing back through the quantity of water into the overhead space where it is not taken up by the water if carbon dioxide gas is introduced by means of a ceramic cartridge. The backflow of the gas to the water level still further increases the forced flow of the water which entrains the gas directly from the entry position to the water level.

According to the prior art the spent impregnated water is topped up by fresh unimpregnated water. To this end, the incoming water is sprayed through suitable nozzles into the head space of the container so that a slight water mist is produced above the liquid level. This procedure results in some pre-impregnation of the freshly supplied water with $CO_2$ gas disposed in the overhead chamber.

The disadvantage of such a procedure however is due to the fact that the spraying nozzles produce a dynamic backpressure which must be overcome by the pump.

In practice, this occurs as follows:

If the gas pressure in the head space of the container is set to 5 bar, the pump must produce a static equilibrium with a backpressure of at least 5 bar, otherwise it will not be possible to pump more liquid into the carbonizer.

Since conventional methods are restricted to spray injection it will be necessary to overcome approximately 3 bar of dynamic backpressure in addition to the pumping head of 5 bar, which means that the pump and its drive must be designed for an output of at least 8 bar. The pump and the motor drive therefore occupy an excessive volume of the apparatus. Moreover, there is a risk of blockage or slow build-up on the spraying nozzles or slits depending on the quality of water (mechanical impurities or compounds containing mineral substances). In these cases the dynamic backpressure will increase until the pump and motor fail completely.

The spray injection method also calls for additional technical complexity, for example the spraying slots or nozzles must not be greater than approximately 0.25 mm.

According to the invention, there is provided apparatus for impregnating water with carbon dioxide, the apparatus comprising a pressure-tight vessel, which, in use, contains a predetermined quantity of water and is provided with cooling surfaces for cooling the water, means for supplying fresh water and carbon dioxide gas to the vessel, and an underwater pump positioned in the vessel so as to be immersed in the water, for producing a water flow within the vessel.

Advantageously, the apparatus also includes means for producing a circulation of carbon dioxide gas which can be superimposed on the water flow which rotates about the, preferably vertical, axis of the cooling surface, substantially parallel with the said axis.

Conveniently, one and the same underwater pump is used for generating the forced carbon dioxide gas circulation and the forced circulation of the water. To this end, the exit of a suction line for the carbon dioxide gas can conveniently merge into a suction chamber of the underwater pump. The other end of the said suction line can extend into a head space of the vessel above the level of the water so that one and the same underwater pump is able to impart to the water a flow which rotates uniformly about the axis of the cooling surface while the carbon dioxide is simultaneously drawn from the head space above the water level and is introduced into the suction chamber of the underwater pump where it is intimately mixed with the water and is introduced into the rotating-flow thereof and small quantities of the carbon dioxide gas in the form of bubbles are able to follow an upwardly oriented helical motion, i.e. they traverse long distances within the quantity of water until they can again rise to the head space above the water level.

The underwater pump, which is totally enclosed, is conveniently disposed in the water so that the suction port and the delivery port of the pump are arranged close to the inside of the hollow cylindrical cooling surface and point in opposite diretions. In this manner, the suction action and the delivery action of the pump can be utilized to create and assist the rotary motion of the quantity of water.

Practically ideal flow conditions are provided for the quantity of water because a short time after starting of the pump the flow creates a rotating cylinder of water within the cooling surface which is preferably of a hollow cylindrical shape. In the circular direction the flow is practically laminar. No deflections or break up of the flow, which could decelerate or impair such flow, can occur. A practically ideal supply of gas into the quantity of water is obtained to the same degree. The carbon dioxide gas is mixed with the water at the place at which the latter assumes the maximum velocity, namely in the pump itself. The intensive vortex action in the pump chamber, substantially closed by the quantity of water, results in intensive mixing of water and carbon dioxide gas. The gas is introduced together with a quantity of water directly into the rotating water cylinder, and therefore it is possible to dispense entirely with a cartridge in the form of a porous ceramic block for the purpose of supplying gas to the quantity of water. Even large bubbles initially participate in the rotary motion of the water column and can rise only slowly to the water surface. The gas bubbles therefore traverse over a substantially longer distance within the water than would correspond to the distance of their entry point below the water surface as measured parallel with the axis of the hollow cylinder. The gas is drawn directly from the head space of the pressure vessel so that it is merely necessary for fresh gas to be supplied to the head space. In this way, the amounts of gas contained in the few bubbles which rise to the surface are again introduced into the forced gas circulation without calling for separate means to this end.

Comparative investigations with known devices of the kind in question have shown that a substantially higher carbon dioxide content can be obtained in the water with a substantially lower expenditure of energy. When the cooling surface is arranged wholly within the vessel, and radially spaced from the wall thereof, the rotary motion of the water column inside the cooling surface also transmits itself to the body of water around the outside of the cooling surface. This body of water rotates about the same axis in the same direction but with a much lower circular velocity, thus enabling the desired ice shell to be built up on the outside of the cooling surface. While maintaining effectiveness the apparatus can be built in an exceptionally space-saving manner so that the apparatus is particularly suited for small automatic beverage dispensers which can be used as built-in units in modular kitchens. The same principle can however be used with the same advantage for larger units of the type used in automatic beverage vending machines, beverage dispensers or other uses.

In certain cases it may be convenient to introduce the carbon dioxide gas into the quantity of water in the same way as previously be means of a porous block. However, an underwater pump is preferred. In the case of higher water columns it is also possible for a plurality of axially spaced water pumps to be disposed one above the other and to be operated in the same manner. It is also possible to provide a larger underwater pump with suction and delivery ports disposed one above the other at a distance from each other, in which case the pairs of ports can be distributed over the height of the water column.

It can also be advantageous to impose a slight motion to the rotating water column in the axial direction. This can be achieved in a simple way, for example by means of helically extending guide surfaces near the cooling surface. An arrangement in which the cooling surface is formed by a helically extending pipe coil is particularly simple. It is also possible however for additional diffuser sections to be welded or attached in some other manner to the cooling coil. Conveniently, the arrangement is made so as to impart a slight twist in the downward axial direction to the water column.

This arrangement leads to an exceptionally rapid temperature equalization, even if water is frequently removed with the accompanying need for supplying fresh water. The temperature can be adjusted with a high degree of accuracy and can be maintained at the desired value even when applying only a slight amount of cooling since the heat exchange between cooling surface and water takes place substantially without the interposition of an ice shield on the inside of the cooling surface. In like manner, it is possible for the carbon dioxide content of the water to be adjusted with exceptional accuracy to the desired value and for this to be maintained even if water is frequently removed since rapid distribution of the carbon dioxide in the entire water column accompanied by optimum utilization of the absorption capacity of the water for carbon dioxide gas is ensured by virtue of this arrangement.

When $CO_2$ gas is drawn into the pump casing, the break up of the $CO_2$ gas in the water resulting from rotation prevents the production of uniform $CO_2$ bubbles. This means that constant selection takes place between gas bubbles which remain dissolved in water because of their small size and those which because of their large volume once again emerge on the surface. This results in fine-pored and effective $CO_2$ impregnation. Such impregnation is so effective as to make it possible to dispense with pre-impregnation obtained by spray injection of the fresh water into the overhead chamber.

An underwater pump which operates in accordance with this method consumes only approximately 5–10 watts to cover the mechanical energy to be supplied. The power thus saved (approximately 3 bar of dynamic backpressure) cannot therefore be compared to the power required for the underwater pump. The pump can remain running constantly, under inoperative conditions as well as when impregnated water is dispensed so that maximum $CO_2$ impregnation is ensured despite the absence of an injection nozzle.

The invention will now be further described, by way of example, with reference to the accompanying drawings, in which:

FIG. 1 shows, in vertical section, a first embodiment of apparatus according to the invention;

FIG. 2 is a horizontal section through the apparatus according to FIG. 1;

Figure 3:
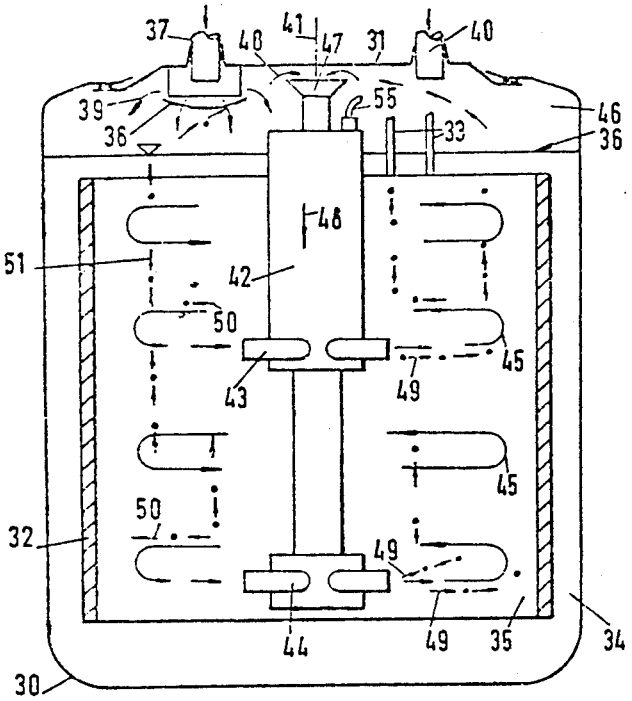
FIG. 3 shows a second embodiment of the apparatus according to the invention and also illustrates the optimum conditions prevailing within the apparatus.

The apparatus 1 comprises a pressure vessel 2, preferably taller than it is wide, which is conveniently constructed in cylindrical form. The pressure vessel can be closed in pressure-tight manner by means of a lid 2'. In operation, the pressure inside the vessel 2 is always above atmospheric pressure. Various supply and measuring devices are disposed in the lid, of which only a supply pipe 5 for pressurized gas and a draw-off pipe 4 for water impregnated with carbon dioxide are indicated in the illustrated example. Both pipes extend outwardly through pressure-tight apertures 3 in the lid 2' and the bottom end of the gas supply duct 5 can, in some cases, extend in the usual manner into a porous member as in the illustrated example, through which said porous member the pressurized gas is introduced directly in the form of superfine gas bubbles into the quantity of water. However, this method of gas introduction is not preferred.

A defined quantity of water 7 is provided in the pressure vessel and the water level of said water is designated with the numeral 8. The charge is arranged so that a head space 6 remains. Means, not shown, are provided to maintain the water level at a specific height and the fresh water is advantageously introduced into the head space in the form of a fine mist.

A hollow cylindrical cooling surface 9 is disposed in the pressure vessel 2. Said cooling surface extends practically over the entire height of the water volume 7 and is immersed completely in the water. Advantageously, the cooling surface is disposed at a substantial radial distance from the internal surface of the pressure vessel 2. In the illustrated example the cooling surface comprises a cooling coil which is helically wound at a defined pitch direction and with a low pitch. A plurality of cooling coils disposed one within the other can also be provided. The cooling surface is connected to a refrigeration unit which is not shown but is disposed outside the pressure vessel. The cooling surface is operated so that an ice shield can be built up thereon to provide adequate cooling capacity in the event of rapid removal of cooled and impregnated water. Suitable sensors can be provided to control the growth of the ice shield and are adapted to trace the external surface and internal surface of the ice shield to control the refrigeration unit accordingly. The interior and where appropriate the exterior of the cooling surface is provided with profiling which can also be formed by surmounted profile elements or the like. In the illustrated example the profiling is formed by the helical configuration of the cooling coil. This profiling will be substantially followed on the internal and external surfaces 11, 14 of the ice shield 13 as can be seen by reference to FIG. 1. Advantageously, the external growth of the ice shield is restricted so that the ice shield cannot reach the inside of the wall of the pressure vessel 2 but defines an annular chamber 12 filled with water which communicates at the top and bottom with the cylindrical body of water disposed within the cooling surface.

In the illustrated example the bottom region of the pressure vessel 2 is provided with an underwater pump 15 whose suction pipe 18 and delivery pipe 19 extend radially outwardly and are bent at their free ends in oppositely oriented circumferential directions so that the suction port **18*a* points in one circumferential direction and the delivery port 19*a* points in the opposite circumferential direction. The water pump can be a conventional underwater pump of the kind used in large aquaria. The axis of rotation of the impeller is designated by the numeral 16**. The motor is totally enclosed and the associated power supply line (not shown) is brought out from the vessel in pressure-tight manner.

By virtue of this arrangement the inner water core 25 is set into rotation as indicated by the arrows 20 with gradual acceleration after the water pump 15 is switched on. After a specific starting time, the inner water core 25 rotates at uniform velocity and there is practically no flow interference about the vertical axis 17 of the cooling surface. The rating of the underwater pump need be designed only to ensure that the static water core is set into rotation on starting and that the energy consumption due to friction can be replaced by the output of the pump. Advantageously, the system is arranged so that the water quantity in the annular chamber 12 is also set in rotation in accordance with the arrows 21 but the rotational velocity in this region is substantially lower than in the core region 25 due to the higher friction in this annular chamber so that the ice shield grows mainly radially outwardly from the cooling surface while the ice stratum of on the inside of the cooling surface is thin. This ensures optimum heat transfer between water and cooling surface and ensures that the refrigeration device can be operated with a low rating without impairing the refrigeration effect.

As the water becomes colder it tends to descend. The downward migration of the colder water can be assisted in controlled manner by adopting an appropriate pitch for the profiling on the cooling surfaces in conjunction with the direction of rotation of the underwater pump.

The suction pipe 18 and the delivery pipe 19 can also be offset relative to each other in the axial direction so that the driving energy can be distributed by the underwater pump over a greater axial region of the water core 25. A plurality of suction ports and delivery ports, distributed in the axial direction and associated with one or more underwater pumps, can also be provided to the same end. As a rule, the arrangement shown in the illustrations is sufficient and the costs of its production and maintenance are particularly low.

While it is quite acceptable for the carbon dioxide gas to be conducted via the pipe 5 into the porous member and to emerge directly from there into the water, it has been found particularly advantageous if the vortex action of the water in the underwater pump is utilized for introducing the carbon dioxide gas and for finely distributing the gas in the water. To this end, a suction line 26 is provided, as indicated in broken lines, the exit side 27 of which extends in sealed manner into the suction region of the underwater pump 15. The carbon dioxide gas drawn in is entrained by the rotating impeller and is intimately mixed with the water, accompanied by a vortex effect, thus ensuring intimate distribution and contact between gas and water while maintaining rapid impregnation. The water, emerging with a high $CO_2$ concentration is rapidly distributed in the water core 25 so that there is hardly any risk of the superfine gas bubbles recombining into larger gas bubbles which rise into the head space 6.

The pipe 26 can be brought out from the vessel. However, advantageously its inlet end 28 opens into the head space 6 and the carbon dioxide gas is introduced from the outside merely into the head space so that the pump draws the gas from the head space of the vessel. This leads to a very simple but effective arrangement.

The apparatus shown in FIG. 3 comprises a pressure vessel 30 with lid 31. A cooling surface 32 of any desired kind, which can be connected by means of ducts 33 to a refrigeration unit not shown, is arranged in the pressure vessel, more particularly at a distance from the internal wall of the vessel, and is in the form of a hollow cylinder.

The pressure vessel is filled with water to the liquid level 36 to leave a head space 46 which is free of liquid. The water fills the external annular chamber 34 as well as the central chamber 35 of the pressure vessel 30.

Connecting pipes 33 for the cooling surface as well as an electric cable 55, for purposes to be explained subsequently, are brought out in pressure-tight sealed manner through the vessel lid. Two pipelines 37 and 40 extend in pressure-sealed manner through the vessel lid into the head space 46 of the vessel. The pipeline 37 is connected to a source of fresh water, for example a water mains. By contrast to known devices, the pipe 37 extends into the head space 46 with an unobstructed cross-section so that a simple water stream is able to emerge and the water is neither sprayed nor atomized. This leads to a substantial reduction of the pressure required to introduce the fresh water into the pressure vessel 30. To prevent the water stream directly striking the water surface 36, the headspace beneath the inlet opening of the pipe 37 is provided with a baffle plate 38 which can be constructed in concave or convex form to spread the water stream in the form of an annular curtain.

The pipeline 40 for the carbon dioxide gas also extends freely into the head space 46, which is therefore filled with carbon dioxide gas.

A circulating device 42 is disposed centrally within the cooling surface 32 in the vessel 31 and is oriented along the axis 41. The circulating device has a double function. It generates a circular water current around the axis 41 in accordance with the arrows 45, by means of two axially spaced underwater pump units 43 and 44 which can be driven by an electric motor connected to the conductor 55 and encapsulated in the unit 42. As in the previously described example, this water flow can also continue in the outer annular chamber 34 but at a substantially lower velocity. The rotary water flow according to the arrow 45 is constantly maintained, independently of the removal or supply of water. (The discharge pipe for water saturated with carbon dioxide is not shown in FIG. 3 in the interests of simplicity).

The unit 42 causes the carbon dioxide gas to flow in a circuit, substantially perpendicular to the rotary flow 45. A suction pipe 47, which extends into the head space 46, is provided to this end and carbon dioxide gas is constantly drawn from the head space through said pipe in accordance with the arrows 48. The carbon dioxide gas drawn in is preferentially drawn in by the pumping units 43 and 44 is intensively mixed, simultaneously with the drawn in water, and introduced into the rotary water flow 45 in accordance with the small arrows 49. To the extent to which gas is not absorbed by the water it rises at any suitable place of the circular water flow 45 upwardly in the form of large bubbles in accordance with the small arrows 51. The rising path need not extend parallel with the axis 41, as shown in simplified form, but will generally describe a helical path which is increasingly oriented with the axis 41.

Rotation of the water as well as pumping of the carbon dioxide gas in circulation takes place constantly independently of any topping up of carbon dioxide gas and water through the pipelines 40 and 37.

Mixing of the gas with the water by the pump results in the formation of very small, small, medium-sized, large and very large bubbles. All bubbles which become too large and do not remain dissolved in the water are conveyed towards the surface due to their large buoyancy, as already described, and top up the gas volume. Constant circulation of the carbon dioxide gas by pumping results in maximum enrichment of the water with carbon dioxide gas. If the temperature of the water is constantly maintained close to the freezing point, it is possible in this way to obtain a carbon dioxide gas enrichment of the order of 11 g per liter and more. Rotation of the water also results in optimum cooling of the water to temperatures close to the freezing point.

This is achieved with one and the same pump which generates the horizontal rotary motion of the water and the gas circulation which is perpendicular thereto. The power rating required for the pump amounts to a few watts.

Figure 4:
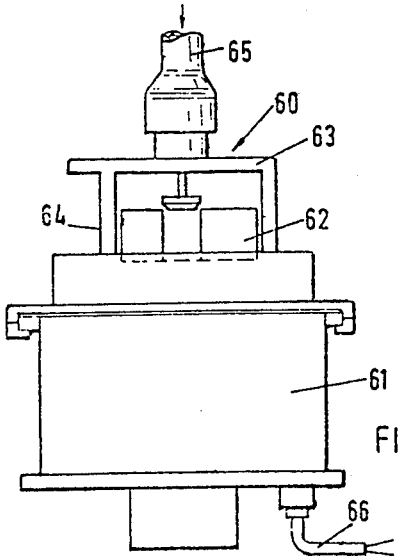
FIG. 4 shows an alternative form of pump for use in the apparatus.

The underwater pump 60 shown in FIG. 4 can be used as an alternative to the pump 15 of FIGS. 1 and 2 or the units 43,44 of FIG. 3.

The pump 60, which will be arranged centrally within a water vessel, has a motor inside a sealed, watertight casing 61. The motor drives a rotor or impeller 62 which is mounted within a cage 63 with windows 64 through which the water is sucked in and pumped out, both in a circumferential direction. $CO_2$ gas is introduced into the cage 63 when it is mixed with the water via a hose 65. A lead 66 for the electrical current is provided.

This pump is simpler and cheaper than those in the other Figures, and may be more suitable for light-duty applications, such as in domestic households.

The apparatus described has advantages over previously known apparatuses, in that fine-pored injection of the gas through correspondingly fine-pored blocks, which are immersed in the water, can be omitted. Accordingly, the apparatus described is substantially simplified and rendered less expensive. Nozzle injection or atomization of the fresh water into the head space, as always necessary hitherto for carbonization or at least for precarbonization, can also be omitted. Instead, the fresh water can be introduced in a simple stream, i.e. with much lower pressure losses, into the head space. This results in a further substantial simplification of the arrangement since the spraying and atomizing nozzle for the water calls for complexity and substantial additional costs. At the same time the operating costs are also lowered since the amount of energy required for introducing fresh water is substantially reduced when it is introduced in a simple stream.

The novel apparatus leads to an intensive impregnating action combined with inexpensive manufacture and efficient operation and the entire construction of the apparatus can also be produced at exceptionally low cost and occupies less space by comparison with known devices of the same capacity. The apparatus is therefore particularly suitable for installation in an automatic beverage vending machine.

The $CO_2$ and carbonic acid content in the water, defined by tests and found to be surprisingly high, is evidently due to the constant circulation by pumping of the $CO_2$ through the water, irrespective of whether or not water is removed from the vessel. This is because the pumped circulation of $CO_2$ through the water is not interrupted during "inoperative times", particularly when only pumps with an energy consumption of, for example, 5–10 W are used.

The expression "cooling surface" used herein refers to the interface between water and a solid surface where heat is transmitted from the water to a refrigerating means. The cooling surface may be the inner side of the vessel wall which can contain or be surrounded by a refrigerating coil or the like. The refrigerating coil may also be arranged adjacent or at a radial distance from the inner side of the vessel wall and may be directly contacted by the water to be cooled, or an ice layer may be interposed between the cooling surface and the water.

What is claim is:

1. Apparatus for impregnating water with carbon dioxide comprising a pressure tight vessel having a vertical central axis, means for supplying fresh water into the vessel at the top thereof to a predetermined water line to define a head space in the vessel above the water line, means for supplying carbon dioxide gas into the vessel at the top thereof above the water line, a motor submerged in water in the vessel below the predetermined water line located on the vertical central axis of the vessel, a liquid pump within the container on the vertical central axis thereof connected to the motor for rotation thereby, said pump having a suction inlet proceeding circumferentially of the vessel in one direction and said pump having a delivery port proceeding circumferentially of the container in the opposite direction, means for drawing carbon dioxide gas from the head space of the vessel above the water line therein into the pump on actuation of the pump by the motor whereby the carbon dioxide gas and water are mixed in the pump and are delivered from the delivery port of the pump in a mixed condition and traverse the vessel in a generally horizontal circular path centered on the axis of the container and a cylinder positioned within the container having an axis of generation substantially congruent with the axis of the vessel and having an outer periphery which is in spaced relation to the inner periphery of the vessel providing an inner and outer cooling surface between the pump and the inner wall of the vessel, whereby the pump produces a circulation of carbon dioxide impregnated water along both the inside and outside cooling surfaces with the circulation velocity of the water along the inside cooling surface being greater than along the outside cooling surface.

* * * * *